US009281630B2

(12) United States Patent
Costello et al.

(10) Patent No.: US 9,281,630 B2
(45) Date of Patent: Mar. 8, 2016

(54) ELECTRICAL CONNECTOR SYSTEMS

(71) Applicant: Tyco Electronics Corporation, Berwyn, PA (US)

(72) Inventors: Brian Patrick Costello, Scotts Valley, CA (US); Michael David Herring, Apex, NC (US); Arash Behziz, Newbury Park, CA (US); Chad William Morgan, Carneys Point, NJ (US); Nathan Lincoln Tracy, Harrisburg, PA (US); Masayuki Aizawa, Tokyo (JP)

(73) Assignees: Tyco Electronics Corporation, Berwyn, PA (US); Tyco Electronics Japan G.K., Kanagawa (JP)

( * ) Notice: Subject to any disclaimer, the term of this patent is extended or adjusted under 35 U.S.C. 154(b) by 56 days.

(21) Appl. No.: 14/328,776

(22) Filed: Jul. 11, 2014

(65) Prior Publication Data

US 2016/0013594 A1 Jan. 14, 2016

(51) Int. Cl.
*H01R 13/648* (2006.01)
*H01R 13/6588* (2011.01)
*H01R 13/6585* (2011.01)

(52) U.S. Cl.
CPC ..... *H01R 13/6588* (2013.01); *H01R 13/6585* (2013.01)

(58) Field of Classification Search
CPC ..... H01R 13/6585–13/6589
USPC ..... 439/607.12–607.15
See application file for complete search history.

(56) References Cited

U.S. PATENT DOCUMENTS

| | | | | |
|---|---|---|---|---|
| 5,632,635 | A * | 5/1997 | Vanbesien | H01R 23/688 439/108 |
| 6,361,374 | B1 * | 3/2002 | Lloyd | H01R 13/518 439/607.12 |
| 6,843,686 | B2 * | 1/2005 | Ohnishi | H01R 23/688 439/607.12 |
| 6,916,988 | B1 | 7/2005 | Auray et al. | |
| 7,572,148 | B1 | 8/2009 | Pepe et al. | |

* cited by examiner

*Primary Examiner* — Khiem Nguyen

(57) ABSTRACT

An electrical connector that includes a housing configured to be coupled to a mating connector. The connector has signal contacts held in signal contact openings. The signal contacts are arranged in arrays of quad groups. Each of the quad group has a set of four contacts arranged in row pairs and column pairs. The signal contacts of each quad group are configured to carry relational signals with each other signal contact in the quad group. Each signal contact is configured to electrically couple to a signal contact of the mating connector. The connector also includes ground shields held in corresponding ground shield openings. The ground shields have walls surrounding a corresponding quad group of signal contacts and provides electrical shielding from adjacent quad groups of signal contacts. The ground shields have mating ends for mating with corresponding ground contacts of the mating connector.

20 Claims, 10 Drawing Sheets

ELECTRICAL CONNECTOR SYSTEMS

BACKGROUND OF THE INVENTION

The subject matter herein relates generally to electrical connector systems.

Some electrical systems, such as network switches and computer servers with switching capability, include receptacle connectors mounted on daughter cards or backplanes that are interconnected by header connectors mounted on opposite sides of a midplane. For example, switch cards may be connected on one side of the midplane, and line cards may be connected on the other side of the midplane. The line cards and switch cards are joined through the header connectors. The header connectors and receptacle connectors typically have electrical contacts that carry signals as differential pairs. However, such systems are limited in the amount of bandwidth, or signal information that may be carried by the differential pair. For example, a typical differential pair transmits a stream of information which is limited by the frequency of electrical pulses that are conveyed along a pair of electrical contacts. Additionally, some systems provide electrical shielding for each pair of electrical contacts, and the shields thereof occupy a considerable amount of space between the pairs of electrical contacts. The footprint of the connectors is large to accommodate the shields.

A need remains for an improved electrical connector system having increased bandwidth and/or a reduced footprint.

BRIEF DESCRIPTION OF THE INVENTION

In one embodiment, an electrical connector is provided including a housing configured to be coupled to a mating connector. The housing has signal contact openings and ground shield openings therethrough. The electrical connector also has signal contacts held in the signal contact openings. The signal contacts are arranged in an array of quad groups. Each of the quad group has a set of four contacts arranged in column pairs and row pairs. The signal contacts of each quad group are configured to carry relational signals with each other signal contact in the quad group. Each signal contact has a mating end configured to be electrically coupled to a corresponding signal contact of the mating connector. The electrical connector also includes ground shields held in corresponding ground shield openings. The ground shields have walls surrounding a corresponding quad group of signal contacts and provides electrical shielding from adjacent quad groups of signal contacts. The ground shields have mating ends for mating with corresponding ground contacts of the mating connector.

In another embodiment, a header connector is provided that includes a header housing having a first end and a second end. The header housing has endwalls at the first and second ends that define a cavity therebetween. The cavity is configured to receive a receptacle connector. The cavity has signal contact openings and ground shield openings therethrough. The header connector also has header signal contacts held in the signal contact openings. The header signal contacts are arranged in an array of quad groups. Each quad group has a set of four contacts arranged in column pairs and row pairs. The header signal contacts of each quad group is configured to carry relational signals with each other signal conductor in the quad group. Each header signal contacts also has a mating end configured to electrically couple to a corresponding receptacle signal contact of the receptacle connector. The header connector also includes header ground shields held in corresponding ground shield openings. The header ground shields have walls surround a corresponding quad group of header signal contacts and provides electrical shielding from adjacent quad groups of header signal contacts. The header ground shields have mating ends for mating with the corresponding ground contacts of the receptacle connector.

In a further embodiment, a receptacle connector is provided that includes a receptacle housing configured to hold a plurality of contact modules. The contact modules include receptacle signal contacts. Each contact module includes a first leadframe and a first dielectric frame that surrounds the first leadframe. Each contact module also includes a second leadframe and a second dielectric frame that surrounds the second leadframe. The receptacle signal contacts extend from mating ends forward of corresponding first and second frames for mating with header signal contacts. The receptacle signal contacts are arranged in column pairs and row pairs forming quad groups. Each quad group comprises a set of four receptacle signal contacts configured to carry relational signals with each other receptacle signal contact in the quad group. The contact modules each comprise a ground shield having receptacle ground contacts extending therefrom. The receptacle ground contacts have walls surrounding a corresponding quad group of receptacle signal contacts. The receptacle ground contacts provide electrical shielding from each adjacent quad group of receptacle signal contacts.

DETAILED DESCRIPTION OF THE INVENTION

Figure 1:
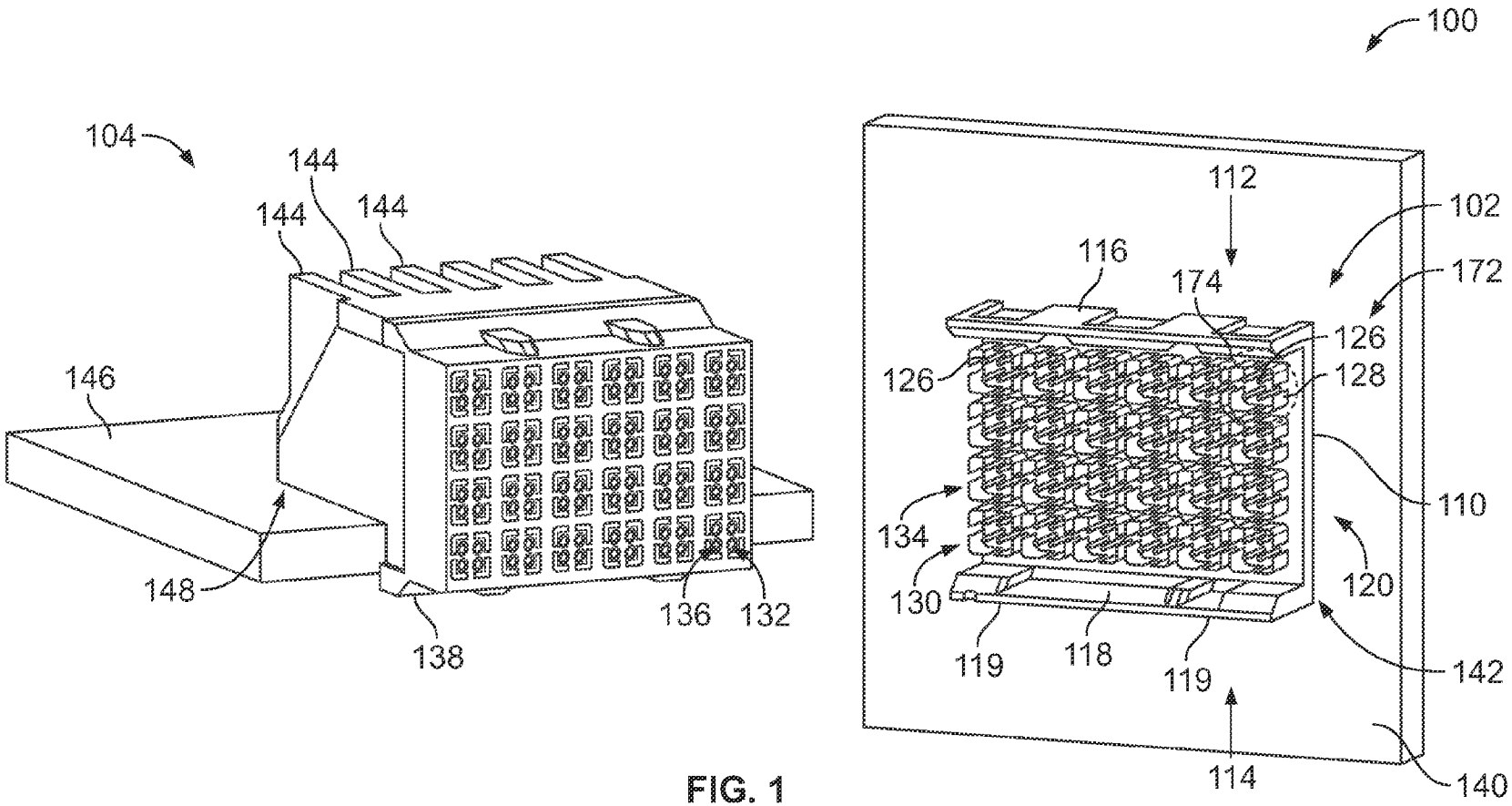
FIG. 1 is a perspective view of an electrical connector system formed in accordance with an exemplary embodiment.

FIG. 1 is a perspective view of an electrical connector system 100 formed in accordance with an exemplary embodiment. The electrical connector system 100 includes electrical connectors 102 and 104 configured to be mated to one another to form an electrical and mechanical connection therebetween. In various embodiments, the electrical connector 102 may be embodied as, and referred to hereinafter as, a header connector 102, and the electrical connector 104 may be embodied as, and referred to hereinafter as, a receptacle connector 104. The receptacle connector 104 is configured to be coupled to the header connector 102. Optionally, the receptacle connector 104 may be part of a daughter card and the header connector 102 may be part of a backplane, or vice versa. Optionally, the header connector 102 and/or the receptacle connector 104 may be part of a line card or a switch card.

In an exemplary embodiment, the header connector 102 and the receptacle connector 104 each include quad groups of signal contacts arranged in rows and columns, as is discussed below. Each signal contact in each quad group is configured to be electrically coupled to a corresponding signal contact of the other electrical connector 102, 104. For example, the header connector 102 includes header signal contacts 126 arranged in an array of quad groups and configured to be electrically coupled to complementary quad groups of receptacle signal contacts 132 in the receptacle connector 104. The contacts in each quad group are configured to carry relational signals with each of the receptacle signal contacts in the quad group, such as sets of differential signals, between various pairs of contacts in the quad group that may be varied to transmit signal information.

The header connector 102 includes a header housing 110 having a first end 112 and a second end 114. The header housing 110 includes endwalls 116 and 118 at the first and second ends 112, 114, respectively. The endwalls 116 and 118 define a cavity 120 therebetween. The cavity 120 is configured to receive the receptacle connector 104 therein. The endwalls 116, 118 may include alignment guides 119 configured to align the receptacle connector 104 with the header connector 102 when the receptacle connector 104 is inserted into the cavity 120.

The header housing 110 includes a plurality of signal contact openings 122 (shown in FIG. 6) and ground shield openings 124 (shown in FIG. 6) in the cavity 120. The header signal contacts 126 are held in the signal contact openings 122, and header ground shields 128 are held in the ground shield openings 124. The header signal contacts 126 are arranged in the cavity 120 in an array 172 of quad groups 174 each having four header signal contacts 126. The header ground shields 128 surround each quad group 174 and provide electrical shielding for the corresponding quad group 174. Each of the header signal contacts 126 has a mating end 130 for electrically coupling with the corresponding receptacle signal contact 132 (also shown in FIG. 9) of the receptacle connector 104. Each of the header ground shields 128 has a mating end 134 for electrically coupling with the corresponding receptacle ground contact 136 (also shown in FIG. 9) of the receptacle connector 104.

The header connector 102 is mounted to a circuit board 140 at a mounting surface 142 of the circuit board 140. As is discussed below in relation to FIG. 7, the mounting surface 142 includes conductive vias 232 (shown in FIG. 8) selectively arranged on the mounting surface 142 and configured to receive the header signal contacts 126 and the header ground shields 128. The header signal contacts 126 and the header ground shields 128 electrically terminate to the circuit board 140.

The receptacle connector 104 includes a receptacle housing 138 used to hold a plurality of contact modules 144. The contact modules 144 are held in a stacked configuration generally parallel to one another. In the illustrated embodiment, the contact modules 144 are oriented generally along vertical planes. The contact modules 144 hold the receptacle signal contacts 132 (also shown in FIG. 9) and receptacle ground contacts 136 (also shown in FIG. 9). The receptacle signal contacts 132 are electrically connected to a circuit board 146 and define signal paths through the receptacle connector 104. The receptacle signal contacts 132 have mating ends 133 (shown in FIG. 9) for electrically coupling with corresponding header signal contacts 126. The receptacle ground contacts 136 have mating ends 135 (shown in FIG. 9) for electrically coupling with corresponding header ground shields 128.

The receptacle connector 104 is mounted to the circuit board 146 at a mounting surface 148 of the circuit board 146. The receptacle signal contacts 132 and the receptacle ground contacts 136 electrically terminate to the circuit board 146. When the receptacle connector 104 is coupled to the header connector 102, the circuit board 140 is orientated perpendicular to the circuit board 146. When coupled, the receptacle signal contacts 132 are electrically connected to the header signal contacts 126 of the header connector 102, and the header ground shields 128 are electrically connected to the receptacle ground contacts 136. In this manner, the header connector 102 and the receptacle connector 104 electrically couple the circuit board 140 to the circuit board 146.

Figure 2:
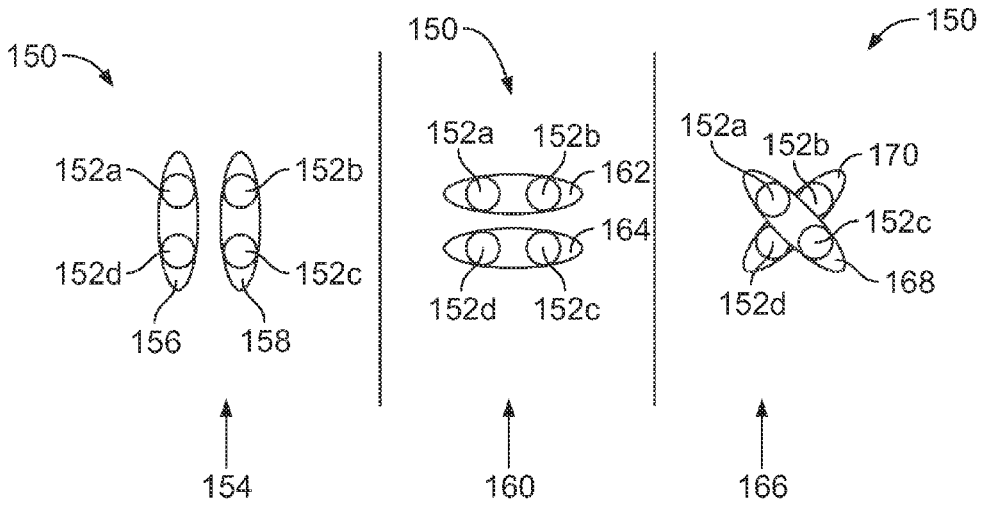
FIG. 2 is schematic illustrating quad groups of signal conductors used to carry relational signals formed in accordance with an exemplary embodiment.

FIG. 2 is a schematic illustration of a quad group 150 of signal contacts 152*a*, 152*b*, 152*c*, and 152*d* used to carry relational signals. Pairings of different sets of the signal contacts are illustrated that may be used to transmit or carry signal information as relational signals. Relational signals, as used herein, refers to a signal difference, for example, a sum or difference in voltage between sets or pairs of the signal contacts 152 that are used to transmit a binary bit of information. The quad group 150 of signal contacts 152 is shown for exemplary purposes, however, the signal contacts 152 may be embodied as the header signal contacts 126 (shown in FIG. 1) and/or the receptacle signal contacts 132 (shown in FIG. 1).

A first pairing 154 includes vertical pairs of differential signals. A first vertical pair 156 includes the signal contacts 152*a* and 152*d*, and a second vertical pair 158 includes the signal contacts 152*b* and 152*c*. A signal difference may be detected between the first vertical pair 156 and the second vertical pair 158 to transmit a first bit of information.

A second pairing 160 includes horizontal pairs of differential signals. A first horizontal pair 162 includes the signal contacts 152*a* and 152*b*, and a second horizontal pair 164 includes the signal contacts 152*c* and 152*d*. A signal difference may be detected between the first horizontal pair 162 and the second horizontal pair 164. The signal difference may be used to transmit a second bit of information that is different from the first bit.

A third pairing 166 includes cross pairs of differential signals. A first cross pair 168 includes the signal contacts 152*a* and 152*c*, and a second cross pair 170 includes the signal contacts 152*b* and 152*d*. A signal difference may be detected between the first cross pair 168 and the second cross pair 170. The signal difference may be used to transmit a third bit of information that is different from the first bit and the second bit.

In this manner, a quad group 150 may be used to concurrently transmit three bits of information via relational signals in the four signal contacts 152.

Figure 3:
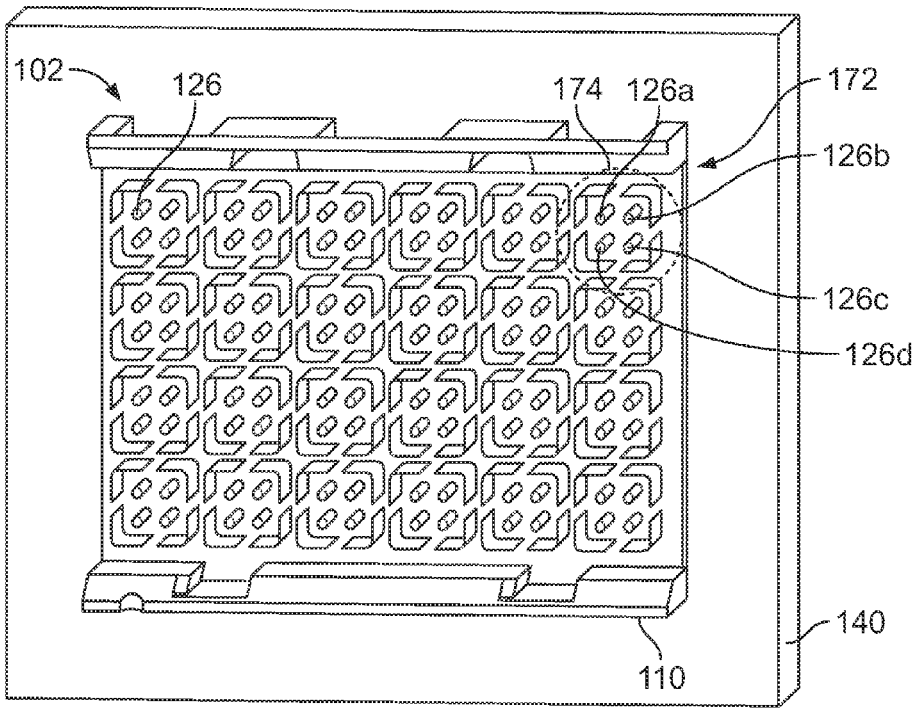
FIG. 3 is a front perspective view of a header connector mounted to a circuit board formed in accordance with an exemplary embodiment.

FIG. 3 is a front perspective view of the header connector 102 mounted to the circuit board 140. The header connector 102 includes the header signal contacts 126 held within the header housing 110 and arranged in an array 172 of quad groups, such as the quad group 174. In the illustrated embodiment shown in FIG. 3, the array 172 includes four rows and six columns of quad groups 174. However, other embodiments may include fewer or more rows or columns of quad groups 174. Each quad group 174 has four header signal contacts 126*a*, 126*b*, 126*c*, and 126*d* arranged in row pairs and column pairs. In the illustrated embodiment, each quad group 174 includes two rows and two columns of signal contacts 126.

Figure 4:
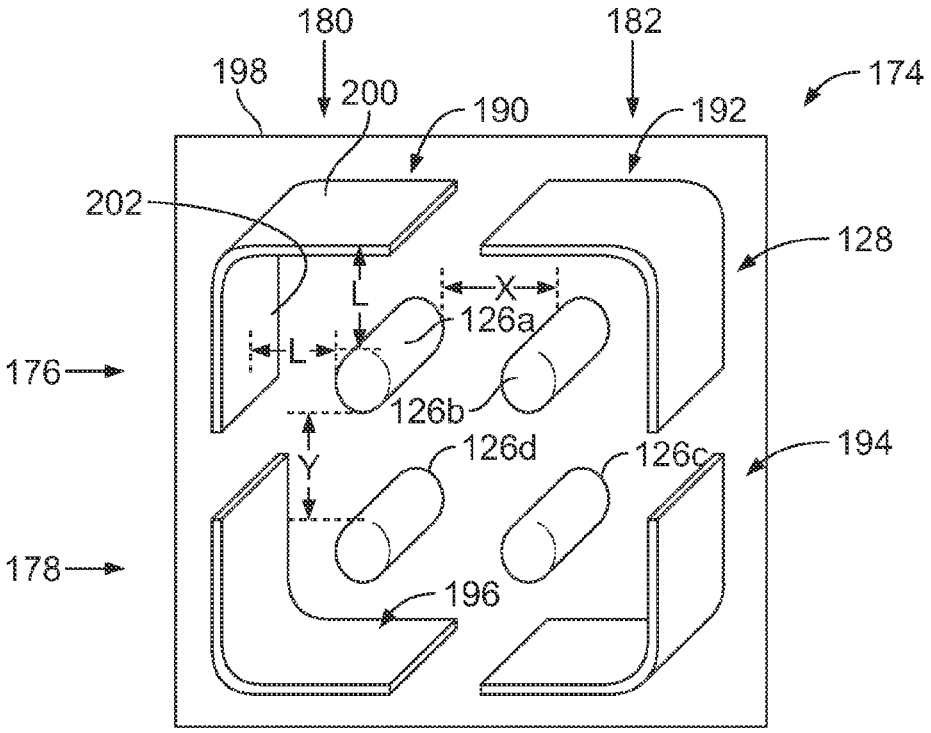
FIG. 4 is a front perspective view of a quad group formed in accordance with an exemplary embodiment.

FIG. 4, with continued reference to FIG. 3, is a front perspective view of one of the quad groups 174. As illustrated, the quad group 174 includes the four header signal contacts 126*a*, 126*b*, 126*c*, and 126*d*. The header signal contacts 126*a* and 126*b* are arranged in a first row pair 176. The header signal contacts 126*c* and 126*d* are arranged in a second row pair 178 below the first row pair 176. The header signal contacts 126*a* and 126*d* are arranged in a first column pair 180. The header signal contacts 126*b* and 126*c* are arranged in a second column pair 182 that neighbors the first column pair 180.

The header signal contacts 126 in the quad group 174 may be arranged in rows and columns such that each header signal contact 126 is approximately equally spaced apart from an adjacent header signal contact 126 in a neighboring row and an adjacent header signal contact 126 in a neighboring column. For example, a distance X may separate the signal contact 126*a* and the signal contact 126*b* in the first row pair 176. A distance Y may separate the signal contact 126*a* and the signal contact 126*d* in the first column pair 180. The distances X and Y may be substantially equal to one another such that the header signal contact 126*a* is positioned approximately equidistant to the header signal contacts 126*b* and 126*d* in the quad group 174. Similarly, the signal contact 126*b* may be approximately equidistant to the signal contact 126*a* and 126*c*. The signal contact 126*c* may be approximately equidistant to the signal contact 126*b* and 126*d*. The signal contact 126*d* may be approximately equidistant to the signal contact 126*a* and 126*c*.

In an exemplary embodiment, the header ground shields 128 provide 360° shielding for the quad group 174 along substantially the entire length of the header signal contacts 126 from the mounting surface 142 (shown in FIG. 1) of the circuit board 140 (shown in FIG. 1) to the mating end 130 (shown in FIG. 1) of the header signal contacts 126. The header ground shields 128 electrically shield each quad group 174 from every other quad group 174. For example, the header ground shields 128 may provide shielding from electromagnetic interference and/or radio frequency interference. The header ground shields 128 may be electrically connected to a ground plane (not shown) of the circuit board 140 (shown in FIG. 1).

In certain embodiments, the header ground shields 128 peripherally surround each of the quad groups 174. Each of the header ground shields 128 has walls 190, 192, 194, and 196. The walls 190-196 surround each of the quad groups 174 along an outer perimeter of each quad group 174. The walls 190-196 surround corresponding quad groups on four sides of each quad group 174. The walls 190-196 provide electrical shielding from an adjacent quad group 174 (as shown in FIG. 3) of header signal contacts 126.

The walls 190-196 may form a ground box 198, as indicated by the shaded line surrounding four sides of the quad group 174. For example, as shown in the illustrated exemplary embodiment in FIG. 4, the walls 190-196 are L-shaped each having longitudinal walls 200 and lateral walls 202. The first wall 190 may form an upper left corner of the ground box 198. The second wall 192 may form the upper right corner of the ground box 198. The third wall 194 may form the lower right corner of the ground box 198. The fourth wall 196 may form the lower left corner of the ground box 198.

The longitudinal walls 200 are spaced equidistant from the header signal contacts 126 in the closest row pair. The lateral walls 202 are spaced equidistant from the header signal contact 126 in the closest column pair. For example, the wall 190 includes the longitudinal wall 200 and the lateral wall 202. The longitudinal wall 200 may be spaced a distance L from the header signal contact 126*a*. The lateral wall 202 may be spaced a distance M from the header signal contact 126*a*. The distances L and M may be substantially similar such that the header signal conductor 126*a* is spaced approximately equidistant from the longitudinal and lateral walls 200, 202. In a similar manner, the longitudinal and lateral walls 200, 202 of the second wall 192 may be equidistant from the header signal contact 126*b*, the longitudinal and lateral walls 200, 202 of the third wall 194 may be equidistant from the header signal contact 126*c*, and the longitudinal and lateral walls 200, 202 of the fourth wall 196 may be equidistant from the header signal contact 126*d*. However, in other embodiments, other arrangements are possible. For example, the distances L and M may not be substantially similar to one another. For example, the distances L and/or M may be varied based on the electrical impedance of the header signal contact 126.

Figure 5:
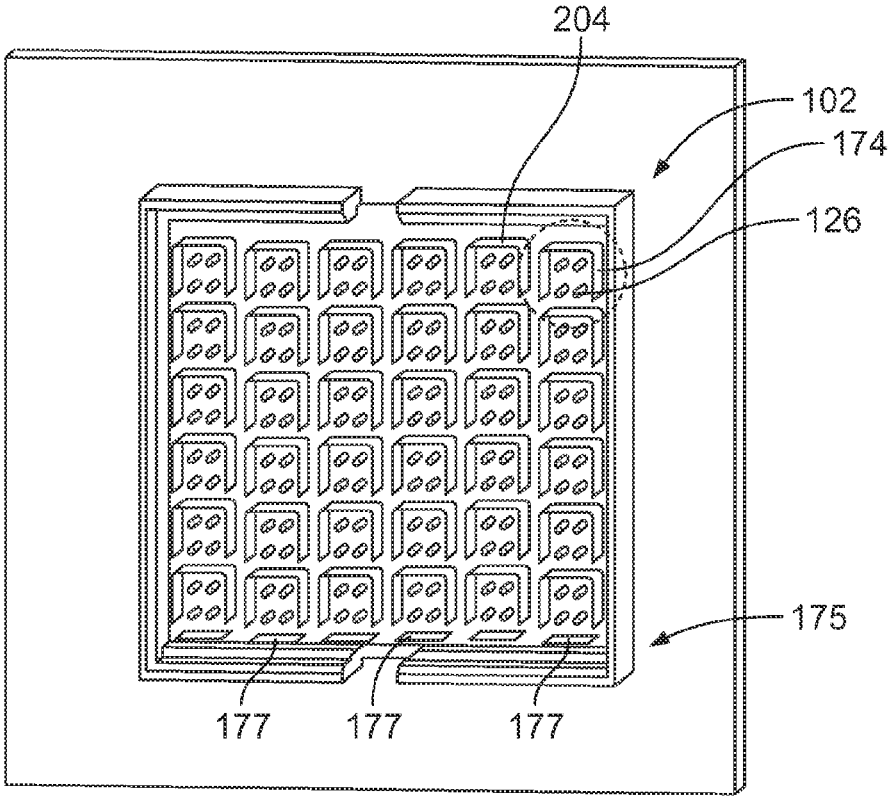
FIG. 5 is a front perspective view of a header connector having C-shaped header shields formed in accordance with an exemplary embodiment.

FIG. 5 is a front perspective view of the header connector 102 having different shaped header ground shields 204 than the header ground shields 128 (shown in FIG. 1). In the illustrated embodiment, each of the quad groups 174 has the C-shaped header ground shield 204, as opposed to the plurality of wall segments 190-196 (shown in FIG. 4) of the L-shaped header ground shield 128. The header ground shield 204 peripherally surrounds a corresponding quad group 174 of header signal contacts 126. The header ground shield 204 covers three sides of the quad group 174. One side of the header ground shield 204 is open. In the illustrated embodiment, the header ground shield 204 has an open bottom, but the header ground shield 204 below the open bottom provides shielding across the open bottom. Each quad group 174 is therefore surrounded on all four sides thereof using the ground shield 204 and the header ground shield 204 below the quad group 174. As such, the header ground shields 204 cooperate to provide circumferential electrical shielding for each quad group 174. The header ground shields 204 electrically shield each quad group 174 from every other quad group 174. In alternative embodiments, other types of header ground shields 204 may be provided. In the illustrated embodiment, a terminal row 175 includes orphan ground shields 177 to provide shielding for the open bottom.

Figure 6:
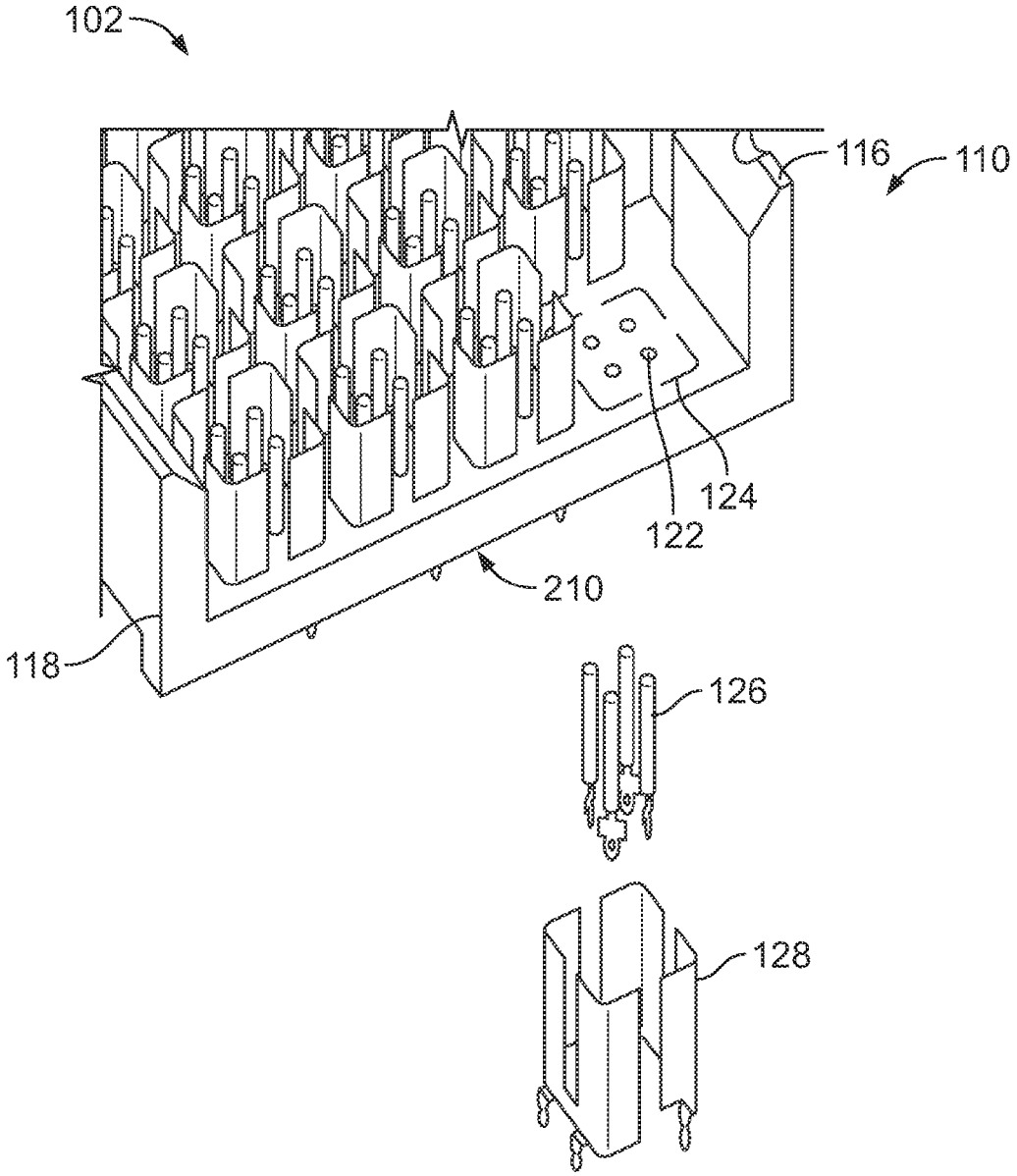
FIG. 6 a top, exploded perspective view of a header connector formed in accordance with an exemplary embodiment.

FIG. 6 is a top, exploded perspective view of the header connector 102 formed in accordance with an exemplary embodiment. The header housing 110 includes a base 210 extending between the endwalls 116, 118. The signal contact openings 122 and the ground shield openings 124 extend through the base 210. The header signal contacts 126 are at least partially received in the signal contact openings 122, and the header ground shields 128 are at least partially received in the ground shield openings 124.

Figure 7:
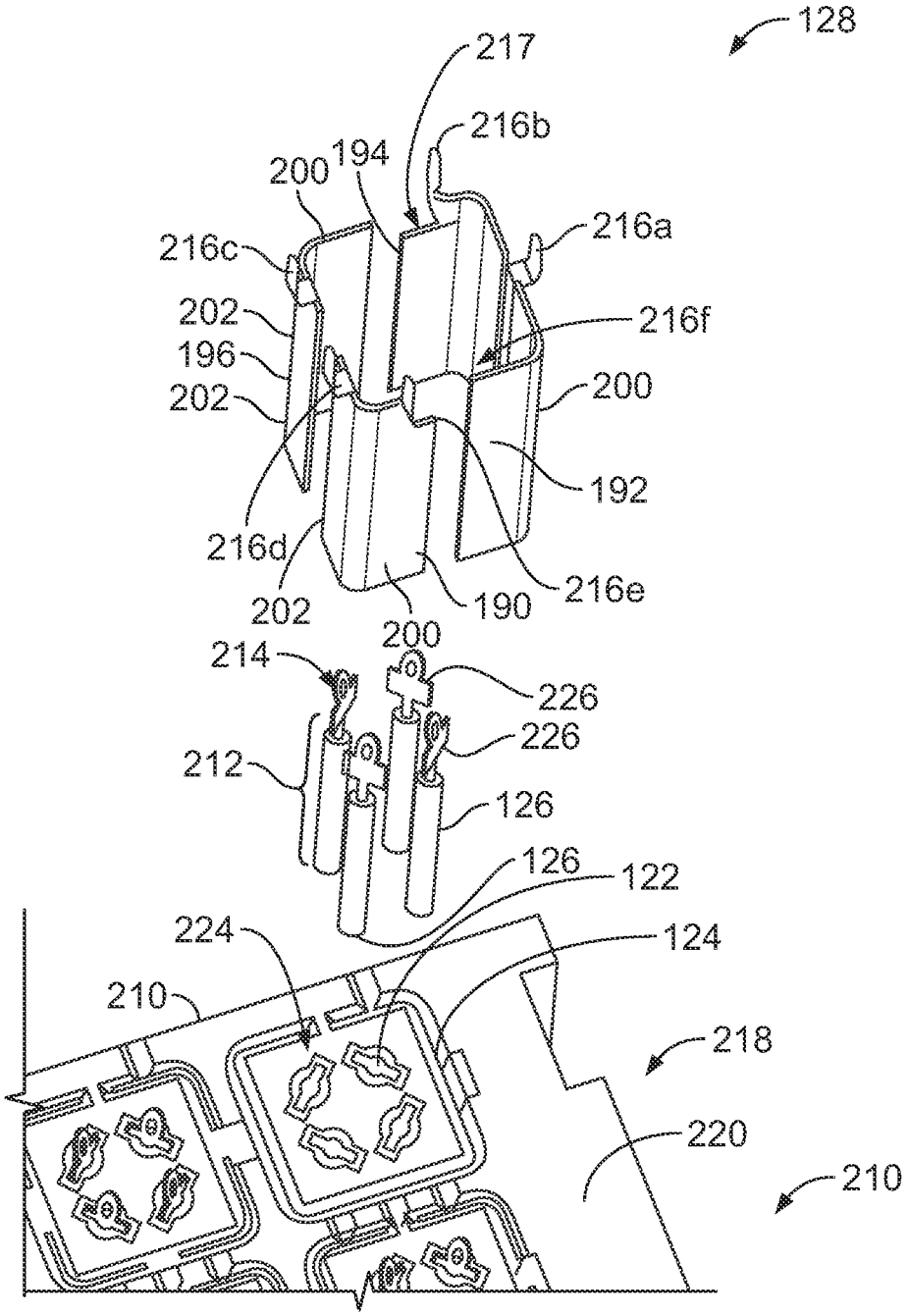
FIG. 7 is a bottom, exploded perspective view of a header connector formed in accordance with an exemplary embodiment.

FIG. 7, with continued reference to FIG. 6, is a bottom, exploded perspective view of the header connector 102 formed in accordance with an exemplary embodiment.

Each of the header signal contacts 126 includes a main body 212 and a mounting portion 214. As illustrated, the mounting contacts 214 are compliant pins, such as eye-of-the-needle pins that are configured to be press-fit into vias 230 (shown in FIG. 8) in the circuit board 140 (shown in FIG. 8). Other types of contacts may be provided in alternative embodiments, such as solder pins, solder tails, solder pads, solder balls, spring tails, and the like. In the illustrated embodiment, the main body 212 is a cylindrical pin that is rolled from a stamped and formed sheet of material. However, in other embodiments, other shapes are possible, such as a square shape.

Each of the header ground shields 128 include the walls 190-196 that terminate to mounting contacts 216*a*, 216*b*, 216*c*, 216*d*, 216*e*, and 216*f*. As illustrated, the mounting contacts 216 are eye-of-the-needle pins that are configured to be press-fit into vias 232 (shown in FIG. 8) in the circuit board 140. However, in other embodiments, other types of mounting contacts 216 are possible. Each of the walls 190-196 may include one or more mounting contacts 216. In the illustrated embodiment, the mounting contact 216*a* is positioned between the second and third walls 192, 194. The mounting contact 216*b* is positioned proximate to an end surface 217 of the third wall 194. The mounting contact 216*c* is positioned proximate to the lateral wall 202 of the fourth wall 196. The mounting contact 216*d* is positioned proximate to the lateral wall 202 of the first wall 190. The mounting contact 216*e* is positioned proximate to the longitudinal wall 200 of the first wall 190. The mounting contact 216*f* is positioned proximate to the longitudinal wall 200 of the second wall 192.

The header signal contacts 126 and the header ground shields 128 may be loaded into respective signal contact openings 122 and ground shield openings 124 through a bottom 218 of the base 210. When inserted into the associated signal contact opening 122, the main body 212 may extend to and through the signal contact opening 122, while a portion of the mounting portion 214 extends below a bottom surface 220 of the bottom 218. The walls 190-196 may extend to and through the ground shield openings 124, while a portion of the mounting contact 216 extends below the bottom surface 220.

The signal contact openings 122 and the ground shield openings 124 may be selectively sized and shaped to retain the header signal contacts 126 and the header ground shields 128 when inserted into the base 210. The signal contact openings 122 include a pin retention zone 224 configured to receive a retainer 226 of the mounting portion 214. The pin retention zone 224 may be selectively oriented to align each of the header signal contacts 126. In the illustrated embodiment, each of the pin retention zones 224 is oriented at approximately 45° with respect to the longitudinal ground shield wall 200 and the lateral wall 202 of one the header ground shields 128. As such, when the header signal contact 126 is inserted into a respective signal contact opening 122, the pin retention zone 224 aligns the retainer 226 of each header signal contact 126 to be oriented approximately perpendicular to the adjacent header signal contact 126. The pin retention zone 224 spaces each of the retainers 226, and hence each signal contact 126, away from an adjacent header ground shield 128. The pin retention zone 224 may be selectively sized to provide a friction or interference fit with the retainer 226 to hold the header signal contact 126 within the signal contact opening 122.

Figure 8:
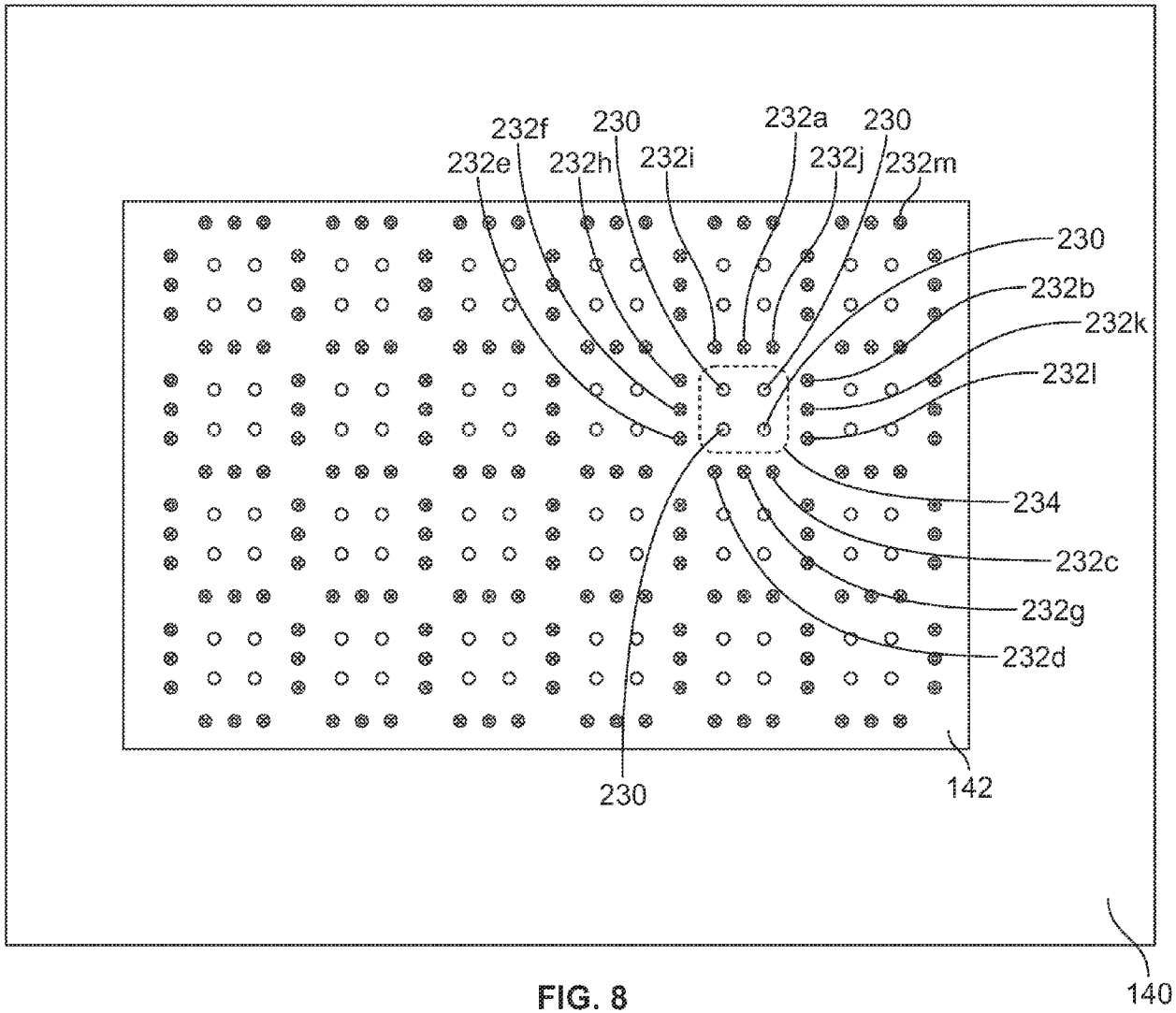
FIG. 8 is a top, exploded perspective view of a backplane circuit board showing conductive vias formed in accordance with an exemplary embodiment.

FIG. 8 is a top view of the circuit board 140 showing conductive vias 230, 232 arranged on the mating surface 142. In the illustrated embodiment, vias 230 are configured to receive the mounting contacts 214 of the header signal contacts 126 (both shown in FIG. 6 and FIG. 7), and vias 232 are configured to receive the mounting contacts 216 of the header ground shields 128 (both shown in FIG. 6 and FIG. 7).

The vias 230, 232 may be arranged in a repeating pattern to receive the array 172 of quad groups 174 (both shown in FIG. 3). The pattern may be repeated to accommodate every quad group 174. A dashed portion 234 illustrates a set of vias 230 configured to receive one quad group 174 of header signal contacts 126. The vias 230 may be arranged in rows and columns with each row being approximately equally spaced apart from an adjacent row and each column being approximately equally spaced apart from an adjacent column.

The vias 232 may also be aligned in rows and columns. Each row and column may receive one or more ground shields 128 (shown in FIG. 7). For example, the first header ground shield 128 may be positioned around the dashed portion 234. Each via 232 receives a corresponding mounting contact 216 (shown in FIG. 7). For example, the via 232*a* receives the mounting contact 216*a*. The via 232*b* receives the mounting contact 216*b*. The via 232*c* receives the mounting contact 216*c*. The via 232*d* receives the mounting contact 216*d*. The via 232*e* receives the mounting contact 216*e*. The via 232*f* receives the mounting contact 216*f*.

Some of the vias 232 receive the mounting contacts 216 of adjacent header ground shields 128. For example, the via 232*g* receives the mounting contact 216*a* of another header ground shield 128 positioned below the first header ground shield 128. The via 232*h* receives the mounting contact 216*b* of another header ground shield 128 positioned to the left of the first header ground shield 128. The vias 232*i*, 232*j* receive the mounting contacts 216*d*, 216*c*, respectively, of another header ground shield 128 positioned above the first header ground shield 128. The vias 232*k*, 2321 receive the mounting contacts 216*f*, 216*e*, respectively, of another header ground shield positioned to the right of the first header ground shield 128. Select vias 232*m* along the perimeter of the array 172 (shown in FIG. 3) may be unoccupied and/or may be filled with a filler material.

Figure 9:
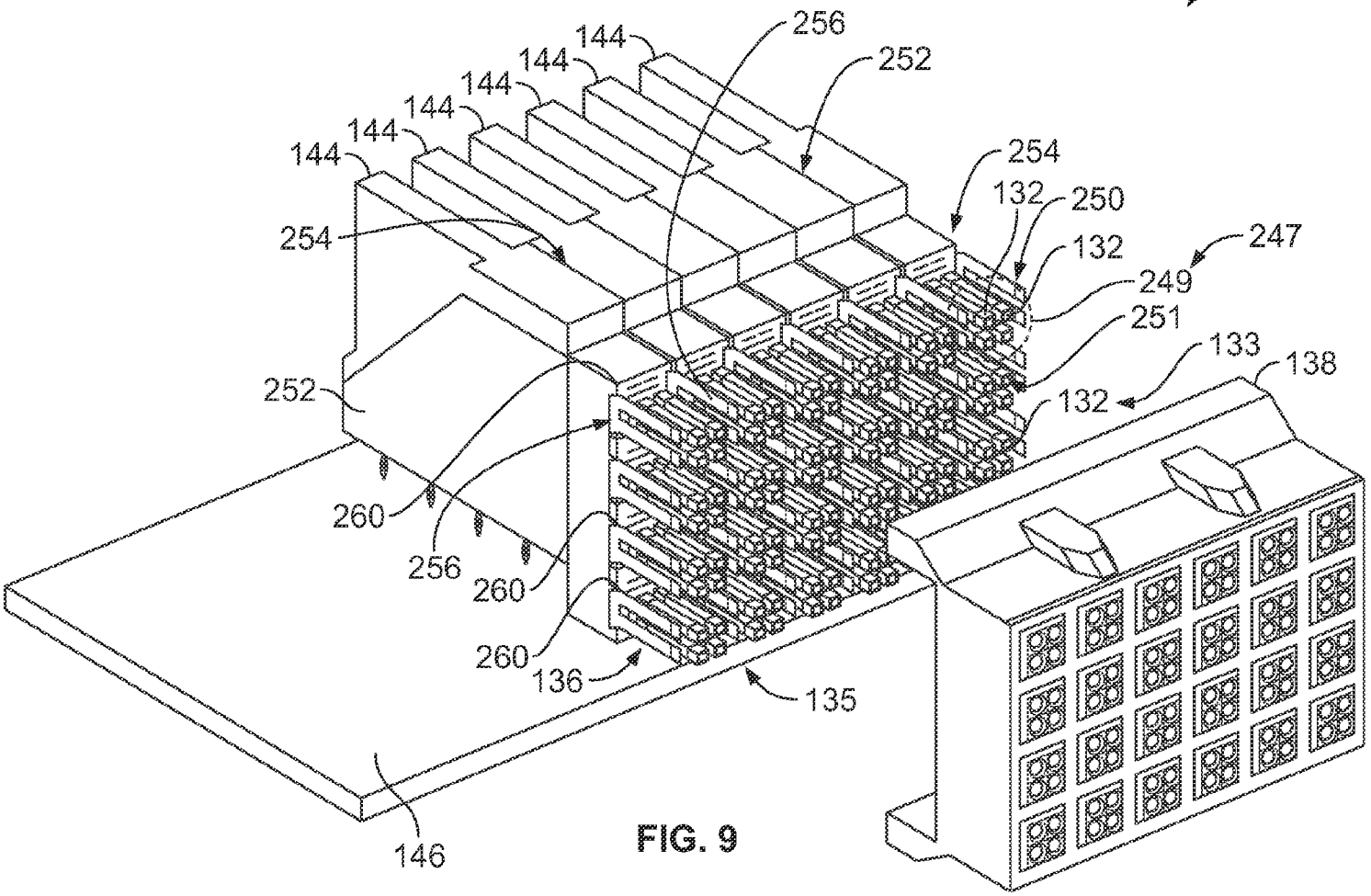
FIG. 9 is a front, exploded perspective view of a receptacle connector formed in accordance with an exemplary embodiment.

FIG. 9 is a front, exploded perspective view of the receptacle connector 104 formed in accordance with an exemplary embodiment. The receptacle housing 138 is illustrated removed from the contact modules 144 and poised to receive the contact modules 144. The receptacle housing 138 is used to hold the contact modules 144 in a stacked configuration generally parallel to one another.

In the illustrated embodiment, the mating ends 133 of the receptacle signal contacts 132 are arranged in an array 247 in quad groups 250, generally indicated by the dashed line 249. As illustrated, the array 247 includes four rows and six columns, however, in other embodiments, other arrangements are possible. Each quad group 250 includes four receptacle signal contacts 132 arranged in column pairs and row pairs. The receptacle signal contacts 132 in each quad group 250 are configured to carry relational signals. Each contact module 144 arranges the quad groups 250 vertically in a column. The receptacle signal contacts 132 in each quad group 250 are symmetrically arranged with respect to one another in rows and columns.

Each of the receptacle signal contacts 132 is generally box shaped with a socket or cavity 251 at the mating end 133 to receive a portion of the header signal contact 126 (shown in FIG. 1). A portion of the body of each signal contact 132 may form one or more spring beams to electrically and mechanically couple to the corresponding header signal contact 126. In alternative embodiments, the receptacle signal contacts 132 may have other shapes, such as a cylindrical shape.

The receptacle connector 104 includes side shields 252 and 254 that surround each of the contact modules 144 on opposite sides thereof. The side shields 252, 254 provide electrical shielding from adjacent contact modules 144 and are electrically connected to a ground plane (not shown) of the circuit board 146. The side shields 252, 254 may be made of any conductive material to provide electrical shielding.

At least some of the receptacle ground contacts 136 may be integral with the side shields 252, 254 and extend from the side shields 252, 254 toward the mating end 135. Such receptacle ground contacts 136 may be referred to hereinafter as shield ground contacts 256. The ground contacts 136 surround the quad groups 250 to provide electrical shielding for each quad group 250. The shield ground contacts 256 flank the signal contacts 132 of each quad group 250 on the opposite sides thereof. The shield ground contacts 256 are aligned in rows with corresponding receptacle signal contacts 132. The receptacle ground contacts 136 also include orphan ground contacts 258 (shown in FIG. 10) that are positioned above and below each quad group 250. The orphan ground contacts 258 are at least partially received in slots 260 in the contact module 144. The slots 260 are vertically positioned above and below each quad group 250, such that when an orphan ground contact 258 is inserted into the slot 260, the orphan ground contact 258 provides electrical shielding between adjacent quad groups 250 in each contact module 144. In alternative embodiments, the orphan ground contacts 258 may be integral with the side shields 252, 254 rather than separate components. Accordingly, the shield ground contacts 256 and the orphan ground contacts 258 provide shielding on four sides of each quad group 250.

Figure 10:
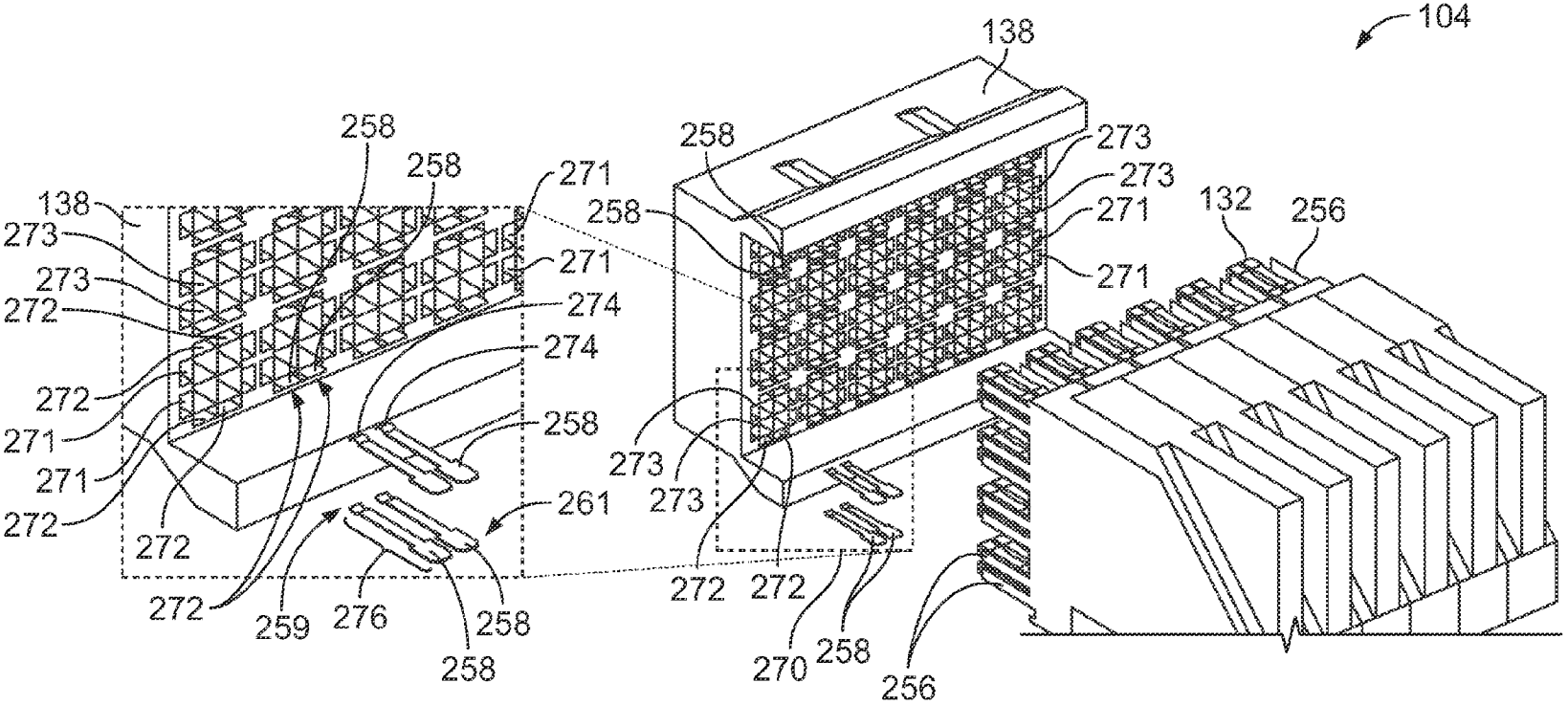
FIG. 10 is a rear, exploded perspective view of a receptacle connector formed in accordance with an exemplary embodiment.

FIG. 10 is a rear, exploded perspective view of the receptacle connector 104 formed in accordance with an exemplary embodiment. The receptacle housing 138 includes a plurality of shield ground slots 271, orphan ground slots 272, and contacts ports 273. Each of the shield ground slots 271 is configured to receive one of the shield ground contacts 256. The shield ground slots 271 are positioned flank each quad group 250 (shown in FIG. 9) on opposite sides thereof. Each of the ground slots 272 is configured to receive one of the orphan ground contacts 258. The ground slots 272 are positioned above and below each group of contact ports 273. The contact ports 273 are distributed in quad groups in the housing 138. The contact ports 273 receive corresponding receptacle signal contact 132.

A select region 270 of the receptacle housing 138 is enlarged to show details of the ground slots 271, 272 and the orphan ground contacts 258. Each orphan ground contact 258 includes a contact pad 274 at a distal end 259 of a body 276 of the ground contact 258. The contact pad 274 is configured to electrically and mechanically couple to the corresponding header ground shields 128 (shown in FIG. 1 and FIG. 6). A proximal end 261 of the body 276 is loaded into the slots 260 (shown in FIG. 9).

Figure 11:
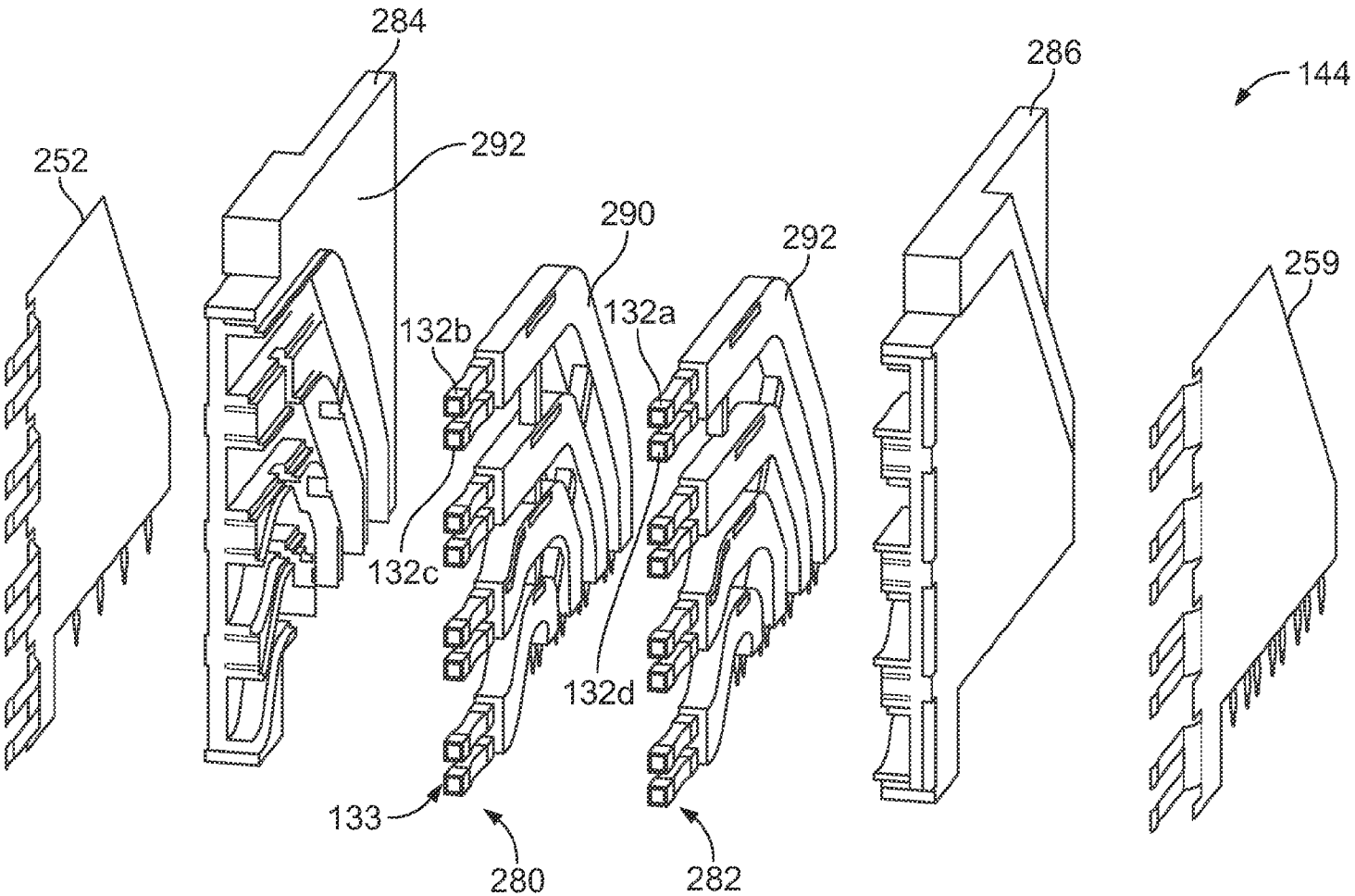
FIG. 11 is an exploded perspective view of a contact module formed in accordance with an exemplary embodiment.

FIG. 11 is an exploded perspective view of the contact module 144 formed in accordance with an exemplary embodiment. The contact module 144 includes a first leadframe 280 and a second leadframe 282 both of which are surrounded by a pair of conductive shells 284 and 286. The side shields 252, 254 are configured to be coupled to the sides of the conductive shells 284, 286, respectively.

The first and second leadframes 280, 282 may be symmetric such that each side is a mirror image of each other about a plane that is centered between 280 and 282. However, in an alternate embodiment, 280 and 282 may be identical to one another. Each leadframe 280, 282 includes pairs of receptacle signal contacts 132 arranged in a column. Each pair of receptacle signal contacts 132 is configured to be aligned with a corresponding pair of receptacle signal contacts 132 in the complementary leadframe 280, 282. For example, the first leadframe 280 includes the receptacle signal contacts 132*b* and 132*c*. The second leadframe 282 includes the receptacle signal contacts 132*a* and 132*d*. When the contact module 144 is assembled, the first leadframe 280 abuts the second leadframe 282 within the shells 284, 286. As such, the receptacle signal contact 132*a* of the first leadframe 280 and the receptacle signal contact 132*b* of the second leadframe 282 are aligned along a first row. The receptacle signal contact 132*c* and 132*d* are aligned along a second row. In this manner, the receptacle signal contacts 132*a*, 132*b*, 132*c*, and 132*d* form the quad group 254 shown in FIG. 9.

The first leadframe 280 is partially encased in a dielectric frame 290 such that at least a portion of the dielectric frame 290 surrounds the first leadframe 280. The second leadframe 282 is also surrounded by a dielectric frame 292. In an exemplary embodiment, the dielectric frames 290, 292 are overmolded over the first and second leadframes 280, 282, respectively.

The conductive shells 284 and 286 are coupled together to encapsulate the leadframes 280, 282. The conductive shells 284, 286 may be complementary or mirrored halves. In an exemplary embodiment, the conductive shells 284, 286 are plated with an electrically conductive material, such as a metal material, to provide shielding for the leadframes 280, 282. For example, the conductive shells 284, 286 may provide shielding from electromagnetic interference and/or radio-frequency interference. In an alternate embodiment, the conductive shells 284, 286 may be constructed of solid metal which could be made by die casting, sintering, machining, or other methods.

Figure 12:
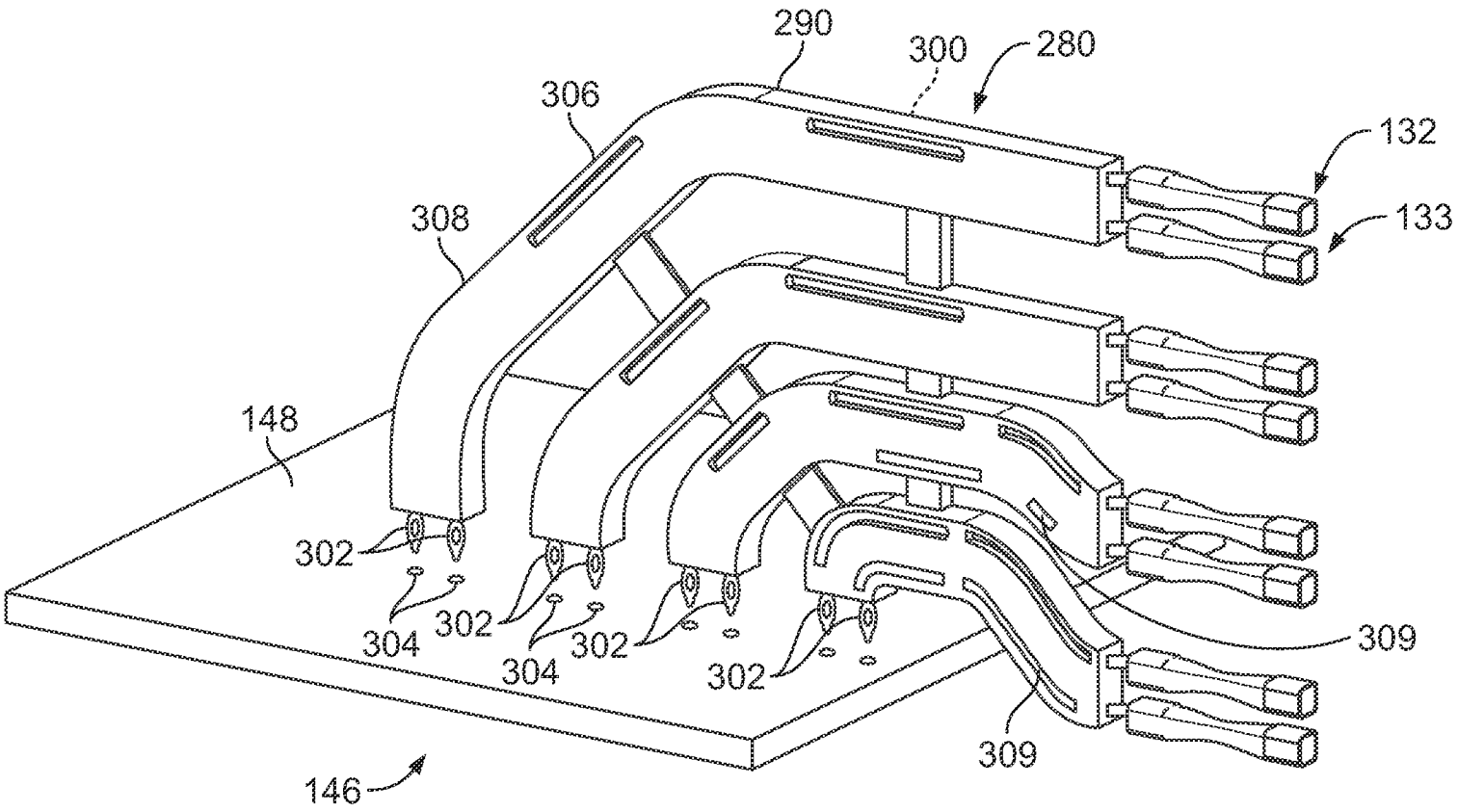
FIG. 12 is a perspective view of a leadframe and a dielectric frame surrounding the leadframe formed in accordance with an exemplary embodiment.

FIG. 12 is a perspective view of the leadframe 280 and the dielectric frame 290 surrounding the leadframe 280 formed in accordance with an exemplary embodiment. Although the first leadframe 280 and the first dielectric frame 290 are illustrated, the second leadframe 282 and the second dielectric frame 292 may be formed in a similar manner having similar components.

In the illustrated embodiment, the receptacle signal contacts 132 extend forward of the dielectric frame 290 toward the mating end 133. The receptacle signal contacts 132 extend downward from the dielectric frame 290 to form mounting contacts 302. The mounting contacts 302 are configured to be mounted to the mounting surface 148 of the circuit board 146. In the illustrated embodiment, the mounting contacts 302 are eye-of-the-needle type pins configured to be mounted to vias 304 on the mounting surface 148 of the circuit board 146.

Transition conductors 300 are encased in the dielectric frame 290. Each transition conductor 300 electrically joins the mating end 133 of each signal contact 132 to the corresponding mounting contact 302. In the illustrated embodiment, the transition conductors 300 orient the mounting contacts 302 perpendicular to the mating end 133 of the signal contacts 132. However, in other embodiments, other orientations are possible.

The dielectric frame 290 may be made of any electrically insulative material, such as a plastic material. The dielectric frame 290 includes at least one grooved portion 306. The grooved portion 306 may be a notch or slot extending along a surface 308 of each of the dielectric frame 290. Optionally, the grooved portions 306 may be air pockets filled with air having a dielectric constant lower than the dielectric constant of the dielectric frame 290. The transition conductors 300 are exposed in the air pockets, which speeds up the signals transitioning along the exposed portions of the transition conductors 300. In an exemplary embodiment, at least some of the grooved portions 306 are filled with plugs 309. The plugs 309 have a dielectric constant that is higher than the dielectric constant of the dielectric frame 290. For example, the plugs 309 may be made of a different material than the dielectric frame 290. The plugs 309 cover or extend along portions of the transition conductors 300, which slows down the signals transmitted along such covered portions of the transition conductors 300. In an exemplary embodiment, the longer transition conductor 300 of each pair is exposed to air by the grooved portion 306, while the shorter transition conductor 300 of each pair is covered by one or more plugs 309. In such manner, the signals in the longer transition conductors 300 are sped up while the signals in the shorter transition conductors 300 are slowed down in an effort to reduce or eliminate skew between the receptacle signal conductors 132.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing configured to be coupled to a mating connector, the housing having signal contact openings and ground shield openings therethrough;

signal contacts held in the signal contact openings, the signal contacts arranged in an array of quad groups, each quad group having a set of four contacts arranged in column pairs and row pairs, the signal contacts of each quad group configured to carry relational signals with each other signal contact in the quad group, each signal contact having a mating end configured to electrically couple to a corresponding signal contact of the mating connector; and ground shields held in corresponding ground shield openings, the ground shields having walls surrounding a corresponding quad group of signal contacts and providing electrical shielding from adjacent quad groups of signal contacts, the ground shields having mating ends for mating with corresponding ground contacts of the mating connector.

2. The electrical connector of claim 1, wherein the electrical connector comprises a header connector, the housing defining a header housing having a first end and a second end, the header housing having end walls at the first and second ends, the endwalls defining a cavity therebetween, the cavity configured to receive the mating connector.

3. The electrical connector of claim 1, wherein the electrical connector comprises a receptacle connector, the housing defining a receptacle housing configured to hold a plurality of contact modules, each contact module including a first leadframe and a first dielectric frame surrounding the first leadframe, and a second leadframe and a second dielectric frame surrounding the second leadframe, the receptacle signal contacts each having a mating end extending forward of the corresponding first and second dielectric frame for mating with corresponding signal contacts of the mating connector.

4. The electrical connector of claim 1, wherein the ground shields form a ground box surrounding the corresponding quad group of signal conductors on four sides thereof.

5. A header connector comprising:

a header housing having a first end and a second end, the header housing having endwalls at the first and second ends, the endwalls defining a cavity therebetween, the cavity configured to receive a receptacle connector, the cavity having signal contact openings and ground shield openings therethrough;

header signal contacts held in the signal contact openings, the header signal contacts arranged in an array of quad groups, each quad group having a set of four contacts arranged in column pairs and row pairs, the header signal contacts of each quad group configured to carry relational signals with each other signal contact in the quad group, each header signal contact having a mating end configured to electrically couple to a corresponding receptacle signal contact of the receptacle connector; and header ground shields held in corresponding ground shield openings, the header ground shields having walls surrounding a corresponding quad group of header signal contacts and providing electrical shielding from adjacent quad groups of header signal contacts, the header ground shields having mating ends for mating with corresponding ground contacts of the receptacle connector.

6. The header connector of claim 5, wherein the walls of the header ground shields surround corresponding quad groups of header signal contacts on four sides.

7. The header connector of claim 5, wherein the header ground shields form a ground box surrounding the corresponding quad groups of the header signal contacts on four sides thereof.

8. The header connector of claim 5, wherein the header ground shields are C-shaped.

9. The header connector of claim 5, wherein the header ground shields are symmetrically arranged around corresponding quad groups of header signal contacts.

10. The header connector of claim 5, wherein the header ground shields form a ground box surrounding the corresponding quad group of header signal contacts.

11. The header connector of claim 5, wherein the header signal contacts of each of the quad groups are arranged in an array in rows and in columns, the walls of the header ground shields being arranged around an outer perimeter of the header signal contacts.

12. The header connector of claim 5, wherein the walls define longitudinal walls and lateral walls, the header signal contacts in each quad group being arranged in rows and columns, the longitudinal walls being spaced equidistant from the header signal contacts in the closest row, the lateral walls being spaced equidistant from the header signal contacts in the closest column.

13. The header connector of claim 12, wherein the walls define longitudinal walls and lateral walls, each header signal contact in each quad group being approximately equally spaced apart from the closest longitudinal wvall and the closest lateral wall.

14. The header connector of claim 5, wherein the header signal contacts define cylindrical pins.

15. The header connector of claim 5, wherein the header signal contacts in each quad group are arranged in rows and columns such that each header signal contact is approximately equally spaced apart from an adjacent header signal contact in a neighboring row and an adjacent header signal contact in a neighboring column within the same quad group.

16. A receptacle connector comprising:

a receptacle housing configured to hold a plurality of contact modules, the contact modules comprising receptacle signal contacts, each contact module includes a first leadframe and a first dielectric frame that surrounds the first leadframe, and a second leadframe and a second dielectric frame that surrounds the second dielectric frame, the receptacle signal contacts extending from mating ends extending forward of corresponding first and second dielectric frames for mating with header signal contacts;

the receptacle signal contacts are arranged in column pairs and row pairs forming quad groups, each quad group comprising a set of four receptacle signal contacts configured to carry relational signals with each of the receptacle signal contacts in the quad group, the contact modules each comprising a ground shield having receptacle ground contacts extending therefrom, the receptacle ground contacts having walls surrounding a corresponding quad group of receptacle signal contacts and providing electrical shielding from each adjacent quad group of receptacle signal contacts.

17. The receptacle connector of claim 16, further comprising a first conductive shell configured to receive the first leadframe and a second conductive shell configured to receive the second leadframe, the first and second conductive shells each have slots receiving corresponding receptacle ground shields, the receptacle ground shields being electrically connected to the first and second conductive shells.

18. The receptacle connector of claim 16, wherein the first dielectric frame includes grooved portions along a surface thereof, the grooved portions configured to change a dielectric constant of the first leadframe.

19. The receptacle connector of claim 18, wherein at least one of the grooved portions is filled with a plug, the first dielectric frame comprising a first material having a first dielectric constant, the plug comprising a second material having a second dielectric constant higher than the first dielectric constant.

20. The receptacle connector of claim 16, wherein the receptacle signal contacts in each quad group are symmetrically arranged in rows and columns.

* * * * *